United States Patent [19]

Maa et al.

[11] 4,189,371

[45] Feb. 19, 1980

[54] MULTIPLE-STAGE HYDROGEN-DONOR COAL LIQUEFACTION PROCESS

[75] Inventors: Peter S. Maa; Lonnie W. Vernon, both of Baytown, Tex.

[73] Assignee: Exxon Research & Engineering Co., Florham Park, N.J.

[21] Appl. No.: 921,669

[22] Filed: Jul. 3, 1978

Related U.S. Application Data

[63] Continuation of Ser. No. 716,036, Aug. 20, 1976, abandoned.

[51] Int. Cl.[2] ..... C10G 1/00; C10G 1/08

[52] U.S. Cl. ..... 208/8 LE; 208/10

[58] Field of Search ..... 208/8 LE,10

[56] References Cited

U.S. PATENT DOCUMENTS

| | | | |
|---|---|---|---|
| 3,598,718 | 8/1971 | Gleim et al. | 208/8 LE |
| 3,607,719 | 11/1969 | Johnson | 208/10 |
| 3,640,816 | 2/1972 | Bull et al. | 208/10 |
| 3,700,584 | 10/1972 | Johanson et al. | 208/10 |
| 4,028,219 | 8/1977 | Baldwin et al. | 208/8 LE |
| 4,045,328 | 8/1977 | Green et al. | 208/8 LE |

FOREIGN PATENT DOCUMENTS 425679 3/1935 United Kingdom .

*Primary Examiner*—Delbert E. Gantz
*Assistant Examiner*—William G. Wright
*Attorney, Agent, or Firm*—Yale S. Finkle

[57] ABSTRACT

An increased yield of hydrogenated liquid product is obtained from coal by treating the feed coal with a hydrogen-donor solvent and hydrogen-containing gas in a first coal liquefaction reactor to produce a liquefaction effluent; separating the liquefaction effluent into a vaporous stream and a liquid stream, the liquid stream consisting of a low molecular weight liquid fraction and a high molecular weight liquid fraction; removing a sufficient amount of the low molecular weight liquid fraction from the high molecular weight liquid fraction to form a heavy bottoms stream containing less than about 50 weight percent of the low molecular weight liquid fraction based on the weight of the high molecular weight liquid fraction; treating the heavy bottoms stream with additional fresh hydrogen-donor solvent and hydrogen-containing gas in a second coal liquefaction reactor; separating the second liquefaction reactor product into a vaporous fraction and a liquid fraction, and recovering hydrogenated liquid products from the vaporous and liquid fractions. If desired the high molecular weight constituents in the liquid fraction from the second liquefaction reactor may be further treated with fresh hydrogen-donor solvent and hydrogen-containing gas in a third coal liquefaction reactor. Hydrogen-donor solvent may be preduced in the process by catalytically hydrogenating at least a portion of the liquid product from each liquefaction reactor, recovering a liquid fraction from the products of the catalytic hydrogenation, and separating a hydrogen-donor solvent from the liquid fraction.

13 Claims, 1 Drawing Figure

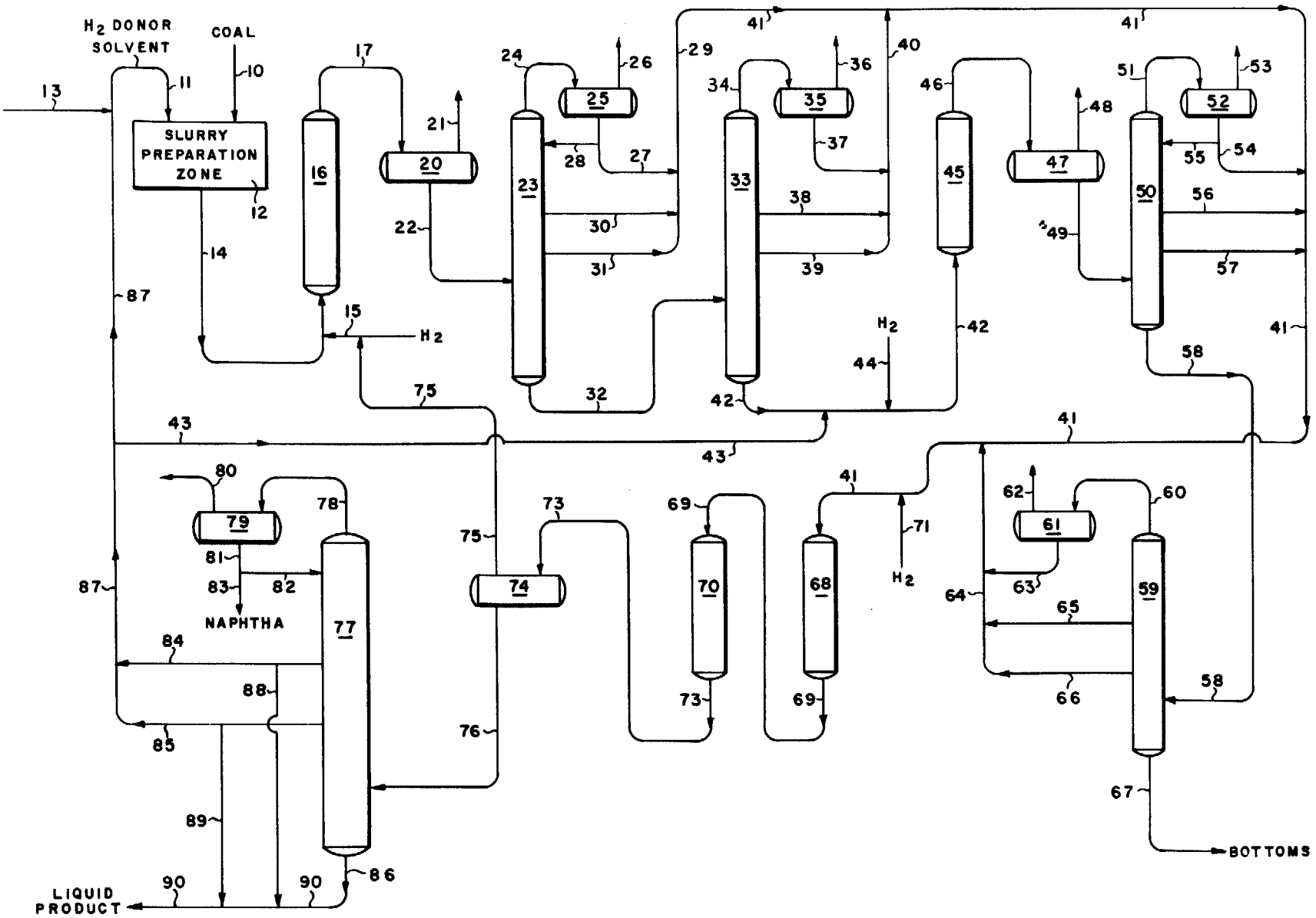
COAL
H2 DONOR SOLVENT
SLURRY PREPARATION ZONE
H2
NAPHTHA
BOTTOMS
LIQUID PRODUCT

MULTIPLE-STAGE HYDROGEN-DONOR COAL LIQUEFACTION PROCESS

This is a continuation, of application Ser. No. 716,036, filed Aug. 20, 1976 now abandoned.

BACKGROUND OF THE INVENTION

1. Field of the Invention

This invention relates to coal liquefaction and is particularly concerned with multiple-stage hydrogen-donor coal liquefaction.

2. Description of the Prior Art

A number of different processes are being developed for the production of liquid hydrocarbons from coal. Among the most promising of these are processes in which the feed coal is first contacted with a hydrogen-containing gas and a hydrogen-donor solvent at elevated temperature and pressure in a liquefaction reactor and a portion of the liquid product is then catalytically hydrogenated in a solvent hydrogenation reactor to generate additional liquid products and a hydrogen-donor solvent for recycle to the liquefaction step. Within the liquefaction zone, the high molecular weight constituents of the coal are cracked and hydrogenated to form lower molecular weight vapor and liquid products. The effluent from the liquefaction reactor is then separated into gases, low molecular weight liquids, and a bottoms stream containing high molecular weight liquids and unconverted mineral matter. The separation of the liquefaction reactor effluent is normally made in such a manner as to produce a bottoms stream consisting of liquids that boil above about 1000° F. The bottoms stream is composed primarily of high molecular weight hydrocarbons formed when the original high molecular weight coal constituents are only partially converted in the liquefaction reactor. Depending on the liquefaction conditions, the bottoms stream will normally contain from about 40 to about 60 weight percent of these high molecular weight hydrocarbons based on the weight of the original dry coal feed.

Although the process outlined above has numerous, advantages over other liquefaction processes, the limited amount of low molecular weight liquids that can be produced, the excessive quantity of high molecular weight bottoms formed and the high consumption of hydrogen, which results from the production of undesirably large quantities of gases and saturated liquids, renders the process somewhat inefficient. To make the process economically more attractive, it is desirable to further convert the bottoms into lower molecular weight liquids and to decrease the hydrogen consumption.

SUMMARY OF THE INVENTION

The present invention provides an improved process for the preparation of liquid products from coal or similar liquefiable carbonaceous solids that at least in part alleviates the difficulties outlined above. In accordance with the invention, it has now been found that an increased yield of hydrogenated liquid products is obtained from bituminous coal, subbituminous coal, lignite or a similar carbonaceous feed material by treating the feed coal with a hydrogen-donor solvent and hydrogen-containing gas in a first liquefaction zone to produce a liquefaction effluent; separating the liquefaction effluent into a vaporous stream and a liquid stream, the liquid stream consisting of a high molecular weight liquid fraction and a low molecular weight liquid fraction; removing a sufficient amount of the low molecular weight liquid fraction from the high molecular weight liquid fraction to form a heavy bottoms stream containing less than about 50 weight percent of the low molecular weight liquid fraction based on the weight of the high molecular weight liquid fraction; treating the heavy bottoms stream with additional fresh hydrogen-donor solvent and hydrogen-containing gas in a second liquefaction zone, separating the second liquefaction zone product into a vaporous fraction and a liquid fraction, and recovering hydrogenated liquid products from the vaporous and liquid fractions.

If desired, the high molecular weight constituents in the liquid fraction from the second liquefaction zone may be separated from the low molecular weight liquids and further treated with fresh hydrogen-donor solvent and hydrogen-containing gas in a third liquefaction zone. As many liquefaction zones as are economically viable may be utilized. Preferably, hydrogen-donor solvent is produced in the process by catalytically hydrogenating at least a portion of the liquid product from each liquefaction zone, recovering a liquid fraction from the products of the catalytic hydrogenation and separating the hydrogen-donor solvent from the liquid fraction.

Normally, the high molecular weight fraction in the liquid effluent from the first liquefaction zone is characterized as consisting of all liquids boiling above at least 650° F., preferably all liquids boiling above a temperature in the range between about 850° F. and about 1100° F. Studies indicate in general that for multiple-stage liquefaction to be effective in increasing overall coal conversion, a sufficient amount of the low molecular weight liquid fraction must be separated from the high molecular weight liquid fraction before the remaining heavy bottoms stream is subjected to further treatment in the second liquefaction zone. The heavy bottoms stream will normally contain less than about 50 weight percent of the low molecular weight liquid fraction based on the weight of the high molecular weight liquid fraction and will preferably contain less than about 20 weight percent. To obtain maximum conversion as much of the low molecular weight liquid fraction as possible should normally be removed. The amount that can be removed, however, will normally be limited by the quantity of low molecular weight liquids needed to insure the pumpability of the bottoms at process temperatures.

The process of the invention results in significant advantages over single-stage hydrogen-donor solvent liquefaction. The amount of coal converted into lower molecular weight liquids is substantially increased while hydrogen consumption and gas make are reduced.

BRIEF DESCRIPTION OF THE DRAWING

The drawing is a schematic diagram of a multiple-stage hydrogen-donor liquefaction process for producing liquid products from coal carried out in accordance with the invention.

DESCRIPTION OF THE PREFERRED EMBODIMENTS

In the process depicted in the drawing, feed coal or similar carbonaceous material is introduced into the system through line 10 from a coal storage or feed preparation zone, not shown in the drawing, and combined with a hydrogen-donor solvent introduced through line 11 to form a slurry in slurry preparation zone 12. The feed coal employed will normally consist of solid particles of bituminous coal, subbituminous coal, lignite, brown coal, or a mixture of two or more such materials. The coal particle size may be on the order of about ¼ inch or larger along the major dimension but will preferably be crushed and screened to a particle size of about 8 mesh or smaller on the U.S. Sieve Series Scale. It is generally preferred to dry the feed coal particles to remove excess water, either by conventional techniques before the solids are mixed with the solvent in the slurry preparation zone or by mixing the wet solids with hot solvent at a temperature above the boiling point of water, preferably between about 250° F. and about 350° F., to vaporize the water in the preparation zone. The moisture in the feed slurry is preferably reduced to less than about 2 weight percent.

The hydrogen-donor solvent used in preparing the coal-solvent slurry will normally be a coal-derived solvent, preferably a hydrogenated recycle solvent containing at least 20 weight percent of compounds that are recognized as hydrogen donors at the elevated temperatures of from about 700° F. to about 1000° F. generally employed in coal liquefaction reactors. Solvents containing at least 50 weight percent of such compounds are preferred. Representative compounds of this type include $C_{10}$–$C_{12}$ tetrahydronaphthalenes, $C_{12}$ and $C_{13}$ acenaphthenes, di, tetra-, and octahydroanthracenes, tetrahydroacenaphthenes, and other derivatives of partially hydrogenated aromatic compounds. Such solvents have been described in the literature and will therefore be familiar to those skilled in the art. The solvent composition resulting from the hydrogenation of a recycle solvent fraction will depend in part upon the particular coal used as the feedstock to the process, the process steps and operating conditions employed, and the conditions used in hydrogenating the solvent fraction selected for recycle following liquefaction. In slurry preparation zone 12, the incoming feed coal is normally mixed with solvent recycled through line 11 in a solvent-to-coal weight ratio of from about 1.0:1 to about 5.0:1, preferably from about 1.0:1 to about 3.0:1. The solvent employed in initial startup of the process and any makeup solvent required can be added to the system through line 13.

The coal-solvent slurry prepared as described above is withdrawn from slurry preparation zone 12 through line 14; mixed with a hydrogen-containing gas, preferably pure hydrogen, injected into line 14 via line 15, preheated to a temperature between about 700° F. and about 1000° F.; and injected into liquefaction reactor 16. The mixture of the slurry and hydrogen-containing gas will contain from about 1 to about 8 weight percent, preferably from about 2 to about 5 weight percent, of hydrogen on a moisture and ash free coal basis. The liquefaction reactor is maintained at a temperature between about 700° F. and about 1000° F., preferably between 800° F. and 900° F., and at a pressure between about 1000 psig and about 4500 psig, preferably between about 1000 psig and about 2500 psig. Although a single liquefaction reactor is shown in the drawing, a plurality of reactors arranged in parallel or series can also be used. Such will be the case if it is desirable to approximate a plug flow situation. The liquid residence time within reactor 16 will normally range between about 5 minutes and about 360 minutes and will preferably be from about 10 to about 120 minutes.

Within the liquefaction zone, high molecular weight constituents of the coal are broken down and hydrogenated to form lower molecular weight gases and liquids. The hydrogen-donor solvent gives up hydrogen atoms that react with organic radicals liberated from the coal and prevent their recombination. The hydrogen injected into line 14 via line 15 serves as replacement hydrogen for depleted hydrogen-donor molecules in the solvent and results in the formation of additional hydrogen-donor molecules by in situ hydrogenation. The process conditions within the liquefaction zone are selected to insure generation of sufficient liquid product for proper operation of the solvent hydrogenation zone. These conditions may be varied as necessary.

The effluent from liquefaction reactor 16, which contains gaseous liquefaction products such as carbon monoxide, carbon dioxide, ammonia, hydrogen, hydrogen sulfide, methane, ethane, ethylene, propane, propylene and the like, unreacted hydrogen from the feed slurry, light liquids, and heavier liquefaction products, is withdrawn from the top of the reactor through line 17 and passed to separator 20. Here the reactor effluent is separated, preferably at substantially liquefaction reactor pressure, into an overhead vapor stream that is withdrawn through line 21 and a liquid stream removed through line 22. The overhead vapor stream is passed to downstream units where the ammonia, hydrogen and acid gases are separated from the low molecular weight gaseous hydrocarbons, which are recovered as valuable by-products. Some of these light hydrocarbons, such as methane and ethane, may be steam reformed to produce hydrogen that can be recycled where needed in the process.

The liquid stream removed from separator 20 through line 22 comprises the liquid effluent from the liquefaction reactor and will normally contain solids in the form of unconverted mineral matter, low molecular weight liquids and high molecular weight liquids. There will normally be a substantial amount of high molecular weight hydrocarbons in the liquid effluent stream since only a portion of the original high molecular weight coal constituents are fully converted into low molecular weight liquids in the liquefaction reactor. The liquid effluent from the reactor may contain up to 50 or more weight percent of these high molecular weight hydrocarbons based on the weight of the coal fed to the slurry preparation zone. Studies indicate that a significant increase in the production of low molecular weight liquids cannot be obtained in a single liquefaction reactor. Failure to convert more of the coal to lower molecular weight liquids makes a single-stage hydrogen-donor liquefaction process somewhat inefficient and uneconomical. It is desirable to obtain as high a conversion of coal into low molecular weight liquids as possible without substantially increasing hydrogen consumption and gas make.

It has been found that the high molecular weight fraction in the liquid effluent from a liquefaction reactor can be further converted into lower molecular weight liquids, thereby increasing coal conversion, by separating the low molecular weight liquid fraction from the high molecular weight liquid fraction, mixing the high molecular weight liquids with fresh hydrogen-donor solvent and additional hydrogen-containing gas, and subjecting the mixture to liquefaction conditions in a second liquefaction zone. This multiple-stage hydrogen-donor liquefaction is much more effective in obtaining further conversion of the high molecular weight liquids without substantially increasing gas make or hydrogen consumption than is single-stage liquefaction in which the coal is treated with the same amount of hydrogen-donor solvent at twice the residence time. As many liquefaction zones as desired may be used to increase the overall conversion of coal into low molecular weight liquids, but it appears that two reactors is the economic optimum.

It has been found that the further conversion of the high molecular weight liquid fraction into lighter liquids cannot be effectively accomplished unless a substantial amount of the low molecular weight liquid fraction is separated from the high molecular weight liquids before they are mixed with fresh solvent and hydrogen-containing gas and again subjected to liquefaction conditions in a second liquefaction zone. As used herein "high molecular weight liquid fraction" refers to that fraction of the liquid effluent from a liquefaction zone that is to be subjected to further conversion in a subsequent liquefaction zone. The high molecular weight liquid fraction is normally characterized as consisting of all liquids boiling above a certain selected temperature plus all the unconverted mineral matter in the liquid effluent. "Low molecular weight liquid fraction," as used herein refers to that fraction of the liquid effluent from a liquefaction zone that contains all the liquids that boil below the selected or demarcation temperature that defines the liquid content of the high molecular weight fraction. The actual demarcation temperature utilized will normally be above about 650° F. and will depend on, among other factors, the conversion and type of products desired. The demarcation temperature will preferably range from about 850° F. to about 1100° F. In the process depicted in the drawing, the demarcation temperature utilized to define the high molecular weight liquid fraction that is to be further converted is 1000° F.

Studies indicate in general that for multiple-stage liquefaction to be effective in increasing coal conversion, a sufficient amount of the low molecular weight liquid fraction should normally be separated from the high molecular weight liquid fraction so that the remaining bottoms stream contains less than about 50 weight percent of the low molecular weight liquid fraction based on the weight of the high molecular weight liquid fraction. To obtain maximum conversion, as much of the low molecular weight liquid fraction as possible should normally be removed when forming the heavy bottoms stream. Preferably, the heavy bottoms stream will contain less than about 20 weight percent of the low molecular weight liquids based on the weight of the high molecular weight liquids.

It is not presently understood exactly why increased amounts of low molecular liquids in the bottoms stream fed to the second liquefaction zone decrease conversion in that zone. It is theorized, however, that polar aromatics in the spent solvent (hydrogen-donor solvent that has given up its hydrogen atoms) and coal-derived liquids formed in the first liquefaction zone are attracted to the coal micelle and block or hinder further hydrogen transfer to these tiny particles. This blockage of further hydrogen transfer will decrease conversion of the high molecular weight constituents in the first liquefaction zone as residence time increases. Thus if the low molecular weight aromatics are not removed from the first liquefaction zone effluent, they will further inhibit conversion in the second liquefaction zone. Removal of the low molecular weight aromatics will also insure that they will not decompose into undesired gases in the second liquefaction zone.

Referring again to the drawing, the liquid withdrawn from separator 20 through line 22 is passed to atmospheric distillation column 23 where the separation of the low molecular weight liquid fraction from the high molecular weight liquids boiling over 1000° F. is begun. In the atmospheric distillation column, the feed is fractionated and an overhead fraction composed primarily of gases and naphtha constituents boiling up to about 400° F. is withdrawn through line 24, cooled and passed to distillate drum 25 where the gases are taken off overhead through line 26. This gas stream may be employed on a fuel gas for generation of process heat, steam reformed to produce hydrogen that may be recycled to the process where needed, or used for other purposes. Liquids are withdrawn from distillate drum 25 through line 27 and a portion of the liquids may be returned as reflux through line 28 to the upper portion of the distillation column. The remaining naphtha can be recovered as product or may be passed through lines 27 and 29 into line 41 and used as feed for the solvent hydrogenation unit, which is described in detail hereafter.

One or more intermediate fractions boiling within the range between about 250° F. and about 700° F. is withdrawn from distillation column 23 for use as feed to the solvent hydrogenation unit. It is generally preferred to withdraw a relatively light fraction composed primarily of constituents boiling below about 500° F. through line 30 and to withdraw a heavier intermediate fraction composed primarily of constituents boiling below about 700° F. through line 31. These two distillate fractions are passed through line 29 into line 41 for use as liquid feed to the solvent hydrogenation unit. The bottoms from the distillation column, composed primarily of constituents boiling in excess of 700° F., is withdrawn through line 32, heated to a temperature between about 600° F. and 775° F., and introduced into vacuum distillation column 33.

In the vacuum distillation column, the feed is distilled under reduced pressure to permit the recovery of an overhead fraction that is withdrawn through line 34, cooled and passed into distillate drum 35. Gases are removed from the distillate drum via line 36 and may either be used as fuel, passed to a steam reformer to produce hydrogen for recycling to the process where needed, or used for other purposes. Light liquids are withdrawn from the distillate drum through line 37. A heavier intermediate fraction, composed primarily of constituents boiling below about 850° F., may be withdrawn from the vacuum distillation tower through line 38 and a still heavier de stream may be withdrawn through line 39. These three distillate fractions are passed through line 40 into line 41 for use as feed to the solvent hydrogenation unit.

The bottoms stream from vacuum distillation column 33 is withdrawn through line 42 and consists primarily of high molecular weight liquids boiling above 1000° F. The atmospheric and vacuum distillation columns 23 and 33 are operated such that the bottoms stream removed via line 42 contain less than about 50 weight percent of low molecular weight liquids boiling below 1000° F. based on the weight of the liquids boiling above 1000° F. Because of the previously described tendency of the low molecular weight liquids to decrease further conversion of the high molecular weight liquids in the second liquefaction reactor, it is desirable to remove as much of the lighter liquids as possible and still maintain the bottoms in a pumpable form. Preferably, the atmospheric and vacuum distillation columns are operated such that the bottoms stream removed from column 33 via line 42 contains less than about 20 weight percent low molecular weight liquids based on the weight of the high molecular weight liquids boiling above 1000° F. The amount of the low molecular weight liquids remaining in the bottoms stream, however, will normally be determined by the quantity needed to insure pumpability of the bottoms at process temperatures.

It will be understood that methods other than the combination of atmospheric and vacuum distillation as described above may be used to separate the low molecular weight liquid fraction from the high molecular weight liquid fraction. Examples of methods that may be used if they yield the desired degree of separation include centrifugation, filtration and the use of hydroclones.

The bottoms stream withdrawn from the vacuum distillation column through line 42 is mixed with fresh hydrogen-donor solvent recycled through line 43 in a solvent-to-bottoms weight ratio of from about 1.0:1 to about 4.0:1, preferably from about 1.0:1 to about 2.0:1. The bottoms-solvent slurry is then mixed with a hydrogen-containing gas, preferably pure hydrogen, injected into line 42 via line 44 and the resultant mixture is preheated and passed into second liquefaction reactor 45. The mixture of the solvent-bottoms slurry and hydrogen-containing gas will contain from about 1 to about 8 weight percent, preferably from about 2 to about 5 weight percent, hydrogen on a moisture and ash-free bottoms basis. The liquefaction reactor 45 is maintained at a temperature between about 800° F. and about 1000° F., preferably between about 820° F. and about 900° F., and at a pressure between about 1000 psig and about 4500 psig, preferably between about 1500 psig and about 3000 psig. Although a single liquefaction reactor is shown in the drawing, a plurality of reactors arranged in parallel or series can also be used. Such will be the case if it is desirable to approximate a plug flow situation. The liquid residence time within reactor 45 will normally range between about 10 minutes and about 240 minutes and will preferably be from about 15 minutes to about 100 minutes.

The reactions taking place in the liquefaction zone in reactor 45 are similar to those that occur in liquefaction reactor 16. The high molecular weight constituents of the bottoms are broken down and hydrogenated to form lower molecular weight gases and liquids. The hydrogen-donor solvent gives up hydrogen atoms that react with organic radicals liberated from the bottoms and prevent their recombination. The hydrogen injected into line 42 via line 44 serves as replacement hydrogen for depleted hydrogen-donor molecules in the solvent and results in the formation of additional hydrogen-donor molecules by in situ hydrogenation.

As much as about a 15 percent increase in the conversion of the coal fed to the slurry preparation zone into low molecular weight liquids boiling below 100° F. may be obtained by subjecting the bottoms from vacuum distillation column 33 to further liquefaction in reactor 45. This increase in light liquid yield is at least in part due to the fact that a substantial amount of spent solvent and coal-derived liquids boiling between about 700° F. and about 900° F. are removed from the liquid effluent from the first liquefaction reactor before the bottoms stream is reslurried with fresh hydrogen-donor solvent and subjected to second-stage liquefaction. Multiple-stage liquefaction not only increases lighter liquid yields but also decreases gas make and the amount of saturated hydrocarbons produced.

The effluent from liquefaction reactor 45 is withdrawn from the top of the reactor through line 46 and passed to separator 47. Here the reactor effluent is separated into an overhead vapor stream that is withdrawn through line 48 and a liquid stream removed through line 49. The vapor stream may either be employed as a fuel gas for generation of process heat, steam reformed to produce hydrogen that may be recycled to the process where needed or used for other purposes. The liquid stream withdrawn from the separator through line 49 is passed to atmospheric distillation column 50 where the separation of low molecular weight hydrocarbons from high molecular weight liquids boiling over 1000° F. is begun.

In atmospheric distillation column 50, the feed is fractionated into an overhead fraction composed primarily of gases and naphtha constituents boiling up to about 400° F. This overhead fraction is withdrawn through line 51, cooled and passed to distillate drum 52 from where the gases are withdrawn through line 53 and employed as a fuel gas for generation of process heat, steam reformed to produce hydrogen that may be recycled to the process where needed, or used for other purposes. Liquids are withdrawn from distillate drum 52 through line 54 and a portion of the liquid may be returned as reflux through line 55 to the upper portion of the distillation column. The remaining naphtha can be recovered as product or may be passed through line 54 into line 41 and used as feed to the solvent hydrogenation unit.

One or more intermediate fractions boiling within the range between about 250° F. and about 700° F. is withdrawn from distillation column 50 for use as feed to the solvent hydrogenation unit. It is generally preferred to withdraw a relatively light fraction composed primarily of constituents boiling below about 500° F. through line 56 and to withdraw a heavier intermediate fraction composed primarily of constituents boiling below about 700° F. through line 57. These two distillate fractions are passed into line 41 for use as liquid feed to the solvent hydrogenation unit. The bottoms from distillation column 50, composed primarily of constituents boiling in excess of 700° F., is withdrawn through line 58, heated to a temperature between about 600° F. and about 775° F., and introduced into vacuum distillation column 59.

In vacuum distillation column 59, the feed is distilled under reduced pressure to permit the recovery of an overhead fraction that is withdrawn through line 60, cooled and passed into distillate drum 61. Gases are removed from the distillate drum via line 62 and may either be used as fuel, passed to a steam reformer to produce hydrogen for recycling to the process where needed or utilized for other purposes. Light liquids are withdrawn from the distillate drum through line 63 and passed through line 64 into line 41 for use as feed to the solvent hydrogenation unit. Heavy intermediate fractions, composed primarily of constituents boiling below about 1000° F., may be withdrawn from the vacuum distillation tower through lines 65 and 66 respectively and passed through line 64 into line 41 for use as additional feed to the solvent hydrogenation unit.

The bottoms from the vacuum distillation column, which consists primarily of high molecular weight liquids boiling above 1000° F., is withdrawn through line 67 and may either be used as a fuel; passed to downstream units to undergo coking, pyrolysis, gasification or some similar conversion process; or utilized for some other purpose. It will be understood that further conversion of the high molecular weight bottoms from the vacuum distillation tower may be obtained by mixing the bottoms with fresh hydrogen-donor solvent and hydrogen-containing gas and subjecting the mixture to liquefaction conditions in a third liquefaction reactor. As many liquefaction reactors as desired may be used in the multiple-stage liquefaction process to increase the overall conversion of the feed coal. The actual number used will depend in part on the desired output and the cost of constructing and operating the liquefaction plant. Studies indicate that the use of two liquefaction reactors will normally yield the most economical multiple-stage hydrogen-donor liquefaction process.

The liquid feed available for solvent hydrogenation includes, as pointed out above, liquid hydrocarbons composed primarily of constituents in the 250° F. to 700° F. boiling range recovered from atmospheric distillation column 23 through line 29 and atmospheric distillation column 50 through lines 54, 56 and 57. It may also include heavier hydrocarbons in the 700° F. to 1000° F. range recovered from vacuum distillation column 33 through line 40 and vacuum distillation column 59 through line 64. These hyrogenation reactor feed components, which are combined in line 41, are heated to solvent hydrogenation temperature, mixed with hydrogen injected into line 41 via line 71 and introduced into the hydrogenation reactor. The particular reactor shown in the drawing is a two-stage downflow unit including an initial stage 68 connected by line 69 to a second stage 70 but other types of reactors can be used if desired.

The solvent hydrogenation reactor is preferably operated at about the same pressure as that in liquefaction reactor 45 and at a somewhat lower temperature than that in the liquefaction reactor. The temperature, pressure and space velocity employed in the reactor will depend to some extent upon the character of the feed stream employed, the solvent used, and the hydrogenation catalyst selected for the process. In general, temperatures within the range between about 550° F. and about 850° F., pressures between about 800 psig and about 3000 psig, and space velocities between about 0.3 and about 3.0 pounds of feed/hour/pound of catalyst are suitable. Hydrogen treat rates within the range between about 500 and about 12,000 standard cubic feet per barrel of feed may be used. It is generally preferred to maintain a mean hydrogenation temperature within the reactor between about 675° F. and about 750° F., a pressure between about 1500 and about 2500 psig, a liquid hourly space velocity between about 1.0 and about 2.5 pounds of feed/hour/pound of catalyst and a hydrogen treat rate within the range between about 500 and about 4,000 standard cubic feet per barrel of feed.

Any of a variety of conventional hydrotreating catalysts may be employed in the process. Such catalysts typically comprise an alumina or silica-alumina support carrying one or more iron group metals and one or more metals from Group VI-B of the Periodic Table in the form of an oxide or sulfide. Combinations of one or more Group VI-B metal oxide or sulfide with one or more Group VIII metal oxide or sulfide are generally preferred. Representative metal combinations which may be employed in such catalysts include oxides and sulfides of cobalt-molybdenum, mickel-molybdenum-tungsten, cobalt-nickel-molybdenum, nickel-molybdenum, and the like. A suitable catalyst, for example, is a high metal content sulfided cobalt-molybdenum-alumina catalyst containing about 1 to 10 weight percent of cobalt oxide and about 5 to 40 weight percent of molybdenum oxide, preferably from 2 to 5 weight percent of the cobalt oxide and from about 10 to 30 weight percent of the molybdenum oxide. Other metal oxides and sulfides in addition to those specifically referred to above, particularly the oxides of iron, nickel, chromium, tungsten and the like, can also be employed. The preparation of such catalysts has been described in the literature and is well known in the art. Generally, the active metals are added to the relatively inert carrier by impregnation from aqueous solution and this is followed by drying and calcining to activate the catalyst. Carriers which may be employed include activated alumina, activated alumina-silica, zirconia, titania, bauxite, bentonite, montmorillonite, and mixtures of these and other materials. Numerous commerical hydrogenation catalysts are available from various catalyst manufacturers and can be used.

The hydrogenation reaction which takes place in reactor stages 68 and 70 is an exothermic reaction in which substantial quantities of heat are liberated. The temperature within the reactor is controlled to avoid overheating, runaway reactions and undue shortening of the catalyst life by controlling the feed temperature and by means of a liquid or gaseous quench stream introduced between the two stages. The quantity of quench fluid injected into the system will depend in part upon the maximum temperature to which the catalyst is to be subjected, characterized of the feed to the reactor, the type of quench used, and other factors. In general, it is preferred to monitor the reaction temperatures at various levels in each stage of the reactor by means of thermocouples or the like and regulate the amount of feed and quench admitted so that the temperature does not exceed a predetermined maximum for that level. The optimum temperature and other conditions for a particular feedstock and catalyst system will be readily determined.

The hydrogenated effluent from the second stage 70 of the reactor is withdrawn through line 73 and passed into separator 74 from which an overhead stream containing hydrogen gas is withdrawn through line 75. This gas stream is at least partially recycled through line 15 for reinjection with the feed slurry into liquefaction reactor 16. Liquid hydrocarbons are withdrawn from the separator through line 76, preheated and passed to final fractionator 77. Here the preheated feed is distilled to produce an overhead product composed primarily of gaseous and naphtha boiling range hydrocarbons. This stream is taken off overhead through line 78, cooled and introduced into distillate drum 79. The off gases withdrawn through line 80 will be composed primarily of hydrogen and normally gaseous hydrocarbons but will include some normally liquid constituents in the naphtha boiling range. This stream may be used as a fuel or employed for other purposes. The liquid stream withdrawn from drum 79 through line 81, composed primarily of naphtha boiling range materials, is in part recycled to the final fractionator as reflux through line 82 and in part recovered as product naphtha from line 83.

One or more side streams boiling above the naphtha boiling range are recovered from fractionator 77. In the particular unit shown in the drawing, a first side stream composed primarily of hydrocarbons boiling up to about 700° F. is taken off through line 84. A second side stream composed primarily of hydrocarbons boiling below about 850° F. is withdrawn from the fractionator through line 85. A portion of each of these two streams is recycled through lines 87, 11 and 43 for use as hydrogen-donor solvent in slurry preparation zone 12 and liquefaction reactor 45 respectively. A bottoms fraction composed primarily of hydrocarbons boiling below about 100 ° F. is withdrawn from the fractionator through line 86 and passed into line 90. The liquids in lines 84 and 85 that are not recycled are passed respectively through lines 88 and 89 into line 90 where they are mixed with the bottoms stream from line 86 to form a liquid product.

The nature and objects of the invention are further illustrated by the results of laboratory and pilot plant tests. The first test illustrates that increased conversion of coal into low molecular weight liquids can be obtained by further treating the high molecular weight bottoms from a first liquefaction zone in a second liquefaction zone. The second series of tests illustrates that aromatic compounds inhibit the conversion of coal into liquids. The final series of tests illustrates that lower molecular weight liquids formed from coal in a first liquefaction zone inhibit the further conversion of the higher molecular weight coal-derived liquids in a second liquefaction zone.

In the first test, the high molecular weight liquids boiling above about 1000° F. produced in a first liquefaction reactor, which was part of a coal liquefaction pilot plant somewhat similar to that depicted in the drawing but not having a second liquefaction reactor and its appurtenant separation equipment, was mixed with fresh hydrogen-donor solvent and hydrogen gas and subjected to liquefaction conditions in a second liquefaction reactor that was part of another pilot plant generally similar to the one in which the first reactor was located. The Illinois No. 6 coal fed to the first liquefaction reactor was ground and screened to −100 mesh on the U.S. Sieve Series Scale and slurried with a coal-derived hydrogen-donor solvent boiling between about 400° F. and about 700° F. in a solvent-to-coal weight ratio of 1.6:1. The slurry was then mixed with 4.0 weight percent molecular hydrogen based on the weight of the feed coal and injected into the reactor, which was operated at 840° F., 1500 psig hydrogen partial pressure, and b 30 minutes residence time. The high molecular weight liquids boiling above about 100° F. produced in the first liquefaction reactor were recovered as bottoms by stripping away the lower molecular weight liquids with hydrogen. The bottoms, which was in the form of a solid residue at room temperature, was ground and screened to −100 mesh on the U.S. Sieve Series Scale, slurried with fresh hydrogen-donor solvent in a solvent-to-bottoms weight ratio of 1.6:1, mixed with 4.0 weight percent molecular hydrogen based on the weight of the bottoms and subjected to liquefaction conditions in the second liquefaction reactor. The second reactor was operated at 840° F., 1500 psig hydrogen partial pressure, and 25 minutes residence time. The results of this pilot plant test are set forth below in Table I.

TABLE I

TWO-STAGE HYDROGEN-DONOR LIQUEFACTION

| Components in Reactor Effluent | First Reactor Wt. % on Dry Feed Coal | Second Reactor Wt. % on Feed Bottoms | Second Reactor Wt. % on Dry Feed Coal |
|---|---|---|---|
| $C_1$–$C_3$ (Gases) | 5.0 | 2.9 | 1.6 |
| $C_4$ - 400° F. (Light Liquids) | 17.4 | 6.1 | 3.3 |
| 400° F.–1000° F. (Heavier Liquids) | 15.2 | 7.9 | 4.2 |
| 1000° F. + (Bottoms-Heavy Liquids plus mineral matter) | 53.0 | 81.1 | 43.0 |

As can be seen from Table I, the effluent from the first liquefaction reactor contained 53.0 weight percent bottoms based on the dry coal feed. Thus only 47.0 weight percent of the coal was converted into liquid materials. The data indicate that 18.9 weight percent of the bottoms was further converted to gases and liquids boiling below 1000° F. in the second reactor. The effluent from the second liquefaction reactor contained 43.0 weight percent bottoms based on the dry feed coal. Thus the overall conversion of coal into materials boiling below 1000° F. in the two-stage process was 57.0 weight percent, a 10.0 percent increase over the conversion obtained in the first reactor. Thus it is seen that a significant increase in coal conversion can be obtained by two-stage hydrogen-donor liquefaction.

The second series of tests illustrates that aromatic hydrocarbons can inhibit the liquefaction of coal. In this series of tests, two 30 ml stainless steel tubing bombs were each charged with Illinois No. 6 coal (ground and screened to −100 mesh on the U.S. Sieve Series Scale) slurried in tetralin, a hydrogen-donor solvent, in a solvent-to-coal weight ratio of 1.6:1 and 2.2 weight percent molecular hydrogen, based on the weight of the coal. The bombs were agitated at 120 cycles per minute for forty minutes in a fluidized sand bath heated to a temperature sufficient to provide a reaction temperature of 840° F., and a pressure of about 1500 psig. After agitation the bombs were allowed to cool to room temperature, gases were bled off overhead, and a slurry consisting of high molecular weight carbonaceous particles and mineral matter suspended in liquid hydrocarbons was recovered from each bomb. Each slurry was washed by mixing it for five minutes with cyclohexane in an amount equal to ten times its weight. The mixture was then centrifuged for 15 minutes at a speed of 2000 rpm. The upper layer, which was rich in cyclohexane, was decanted and the remaining bottom layer was remixed with cyclohexane and washed again as described above. This wash procedure was performed a total of five times. The amount of solid residue from each bomb that did not dissolve in the cyclohexane was measured and the respective values averaged to yield an average cyclohexane conversion of 51.1 weight percent based on the weight of the dry feed coal. For comparison purposes the above-described experiment was repeated five times with an additional 20 weight percent (on dry coal) of naphthalene, phenanthrene, pyrene, chrysene, and anthracene respectively added to each tubing bomb before agitation. The results of these tests are set forth in Table II below.

TABLE II

INHIBITION EFFECT OF AROMATICS ON COAL LIQUEFACTION

| Aromatic Compound Present | Pressure (psig) | Gas Make (Wt. % Dry Coal) | Liquid Yield* (Wt. % Dry Coal) | Solid Residue (Wt. % Dry Coal) | Average Cyclo-Hexane Conversion (Wt. % Dry Coal) | Liquid Yield* Decrease (Wt. % Dry Coal) |
|---|---|---|---|---|---|---|
| None | 1790 | 7.66 | 43.8 | 48.9 | 51.1 | 0.0 |
| Naphthalene | 1800 | 8.48 | 39.0 | 52.8 | 47.2 | 4.8 |
| Phenanthrene | 1850 | 6.72 | 35.8 | 57.5 | 42.5 | 8.0 |
| Pyrene | 1770 | 7.58 | 37.8 | 55.0 | 45.0 | 6.0 |
| Chrycene | 1710 | 6.82 | 35.7 | 57.6 | 42.4 | 8.1 |
| Anthracene | 1770 | 7.50 | 39.6 | 53.2 | 46.8 | 4.2 |

*Includes both hydrocarbon liquids and water.

It can be seen from Table II that the addition of the aromatic compound decreased the average cyclohexane conversion which resulted in a liquid yield decrease from between 4.2 and 8.0 weight percent dry coal. The data illustrate the inhibitory effect that aromatics have on coal liquefaction and indicate that such aromatics should be separated from the heavier molecular weight coal constituents before further liquefaction of these constituents is attempted in another stage.

The following series of tests illustrate the inhibitory effect on liquefaction produced by heavy coal derived liquids. In this series of Tests, two 30 ml stainless steel tubing bombs were each charged with liquefaction bottoms (ground and screened to −60 mesh on the U.S. Sieve Series Scale) slurried in partially hydrogenated creosote oil in a solvent-to-bottom weight ratio of 1.6:1 and 2.6 weight percent molecular hydrogen, based on the weight of the bottoms. The liquefaction bottoms was produced in a coal liquefaction pilot plant somewhat similar to that depicted in the drawing but without a second liquefaction reactor and its appurtenant separation equipment and consisted primarily of high molecular weight liquids boiling above 1000° F. The partially hydrogenated creosote oil contained about 2.0 weight percent of donatable hydrogen. The bombs were agitated at 120 cycles per minute for 30 minutes in a fluidized sand bath, which was heated to a temperature sufficient to provide a reaction temperature of 840° F. and a pressure of about 1500 psig. After agitation the bombs were allowed to cool to room temperature, gases were bled off overhead and a slurry consisting of high molecular weight carbonaceous particles and mineral matter suspended in liquid hydrocarbons was recovered from each bomb. Each slurry was washed with cyclohexane in an amount equal to ten times its weight. The wash was carried out in the same manner as the wash described in the second series of tests above. The wash procedure was repeated ten times. The amount of solid residue from each bomb that did not dissolve in the cyclohexane was measured and the respective values averaged to yield an average cyclohexane conversion of 24.0 weight percent based on the weight of the dry bottoms charged to the tubing bombs. For comparison purposes the above-described experiment was repeated three times with an additional 10 weight percent, 20 weight percent, and 30 weight percent, of a heavy coal-derived liquid respectively added to each tubing bomb before agitation. The heavy coal-derived liquid boiled in the range from about 700° F. to about 1000° F. and was produced in the same coal liquefaction pilot plant from which the liquefaction bottoms fed to the tubing bombs was obtained. The results of these tests are set forth in Table III below.

TABLE III

INHIBITION EFFECT OF COAL-DERIVED LIQUIDS ON COAL LIQUEFACTION

| Amount of Coal-Derived Liquid (Wt. % Bottoms) | Average Cyclohexane Conversion (Wt. % Bottoms) |
|---|---|
| None | 24.0 |
| 10.0 | 22.7 |
| 20.0 | 20.4 |
| 30.0 | 14.5 |

As can be seen from Table III, the average cyclohexane conversion of the bottoms decreased as more of the coal-derived liquids were added to the tubing bombs. This data indicates the importance of removing as much of the coal-derived liquids from the higher boiling liquids (bottoms) that are to be subjected to further liquefaction in a subsequent liquefaction zone.

It will be apparent from the preceding discussion that the invention provides an improved process for converting coal into a hydrogenated liquid product. The process results in an increased yield of hydrogenated liquid product, a decrease in the amount of high molecular weight bottoms produced, and a reduction in the amount of hydrogen consumed.

What is claimed is:

1. A multiple-stage hydrogen-donor liquefaction process for producing liquid hydrocarbons from coal or similar liquefiable carbonaceous solids which comprises:

(a) contacting said carbonaceous solids with a first stream of hydrogen-donor solvent and a hydrogen-containing gas under liquefaction conditions in a first liquefaction zone to produce a liquefaction effluent;

(b) separating said liquefaction effluent into a vaporous stream and a liquid stream, said liquid stream consisting of a high molecular weight liquid fraction composed of substantially all mineral matter and substantially all liquids boiling above at least about 650° F. including substantially all high molecular weight unconverted coal constituents, and a low molecular weight liquid fraction;

(c) separating a sufficient amount of said low molecular weight liquid fraction from said high molecular weight liquid fraction to form a heavy bottoms stream containing substantially all of said high molecular weight liquid fraction, including substantially all of said mineral matter and substantially all of said unconverted coal constituents, and less than about 50 weight percent of said low molecular weight liquid fraction based on the weight of said high molecular weight liquid fraction;

(d) contacting said heavy bottoms stream with a second stream of hydrogen-donor solvent and a hydrogen-containing gas under liquefaction conditions in a second liquefaction zone;

(e) separating the effluent from said liquefaction zone into a vaporous fraction and a liquid fraction; and (f) recovering liquid hydrocarbonaceous products from said vaporous and said liquid fractions.

2. A process as defined in claim 1 wherein said heavy bottoms stream contains less than about 20 weight percent of said low molecular weight liquid fraction based on the weight of said high molecular weight liquid fraction.

3. A process as defined in claim 1 wherein said high molecular weight liquid fraction is composed of substantially all mineral matter and substantially all liquids boiling above a temperature in the range from about 850° F. to about 1100° F. including substantially all high molecular weight unconverted coal constituents.

4. A multiple-stage hydrogen-donor liquefaction process for producing liquid hydrocarbons from coal or similar liquefiable carbonaceous solids which comprises:

(a) contacting said carbonaceous solids with a first stream of hydrogen-donor solvent and hydrogen gas in a first liquefaction zone at a temperature in the range between about 700° F. and about 1000° F. and at a pressure between about 1000 psig and about 4500 psig to produce a liquefaction effluent;

(b) separating said liquefaction effluent into a vaporous stream and a liquid stream, said liquid stream consisting of a high molecular weight liquid fraction composed of substantially all mineral matter and substantially all liquids boiling above a temperature in the range between about 850° F. and about 1100° F. including substantially all high molecular weight unconverted coal constituents, and a low molecular weight liquid fraction;

(c) separating a sufficient amount of said low molecular weight liquid fraction from said high molecular weight liquid fraction to form a heavy bottoms stream containing substantially all of said high molecular weight liquid fraction, including substantially all of said mineral matter and substantially all of said unconverted coal constituents, and less than about 50 weight percent of said low molecular weight liquid fraction based on the weight of said high molecular weight liquid fraction;

(d) contacting said heavy bottoms stream with a second stream of hydrogen-donor solvent and hydrogen gas in a liquefaction zone at a temperature within the range between about 800° F. and about 1000° F. and at a pressure between about 1000 psig and about 4500 psig;

(e) separating the effluent from said second liquefaction zone into a vaporous fraction and a liquid fraction; and (f) recovering liquid hydrocarbonaceous products from said vaporous and said liquid fractions.

5. A process as defined in claim 4 wherein said heavy bottoms stream contains less than about 20 weight percent of said low molecular weight liquid fraction based on the weight of said high molecular weight liquid fraction.

6. A process as defined in claim 4 wherein said high molecular weight liquid fraction is composed of substantially all mineral matter and substantially all liquids boiling above about 1000° F. including substantially all high molecular weight unconverted coal constituents.

7. A multiple-stage hydrogen-donor liquefaction process for producing liquid hydrocarbons from coal or similar liquefiable carbonaceous solids which comprises:

(a) contacting said carbonaceous solids with a first stream of hydrogen-donor solvent and a hydrogen-containing gas in a first liquefaction zone at a temperature in the range between about 700° F. and about 1000° F. and at a pressure between about 1000 psig and about 4500 psig to produce a liquefaction effluent;

(b) separating said liquefaction effluent into a vaporous stream and a liquid stream, said liquid stream consisting of a high molecular weight liquid fraction composed of substantially all mineral matter and substantially all liquids boiling above at least 650° F. including substantially all high molecular weight unconverted coal constituents, and a low molecular weight liquid fraction;

(c) separating a sufficient amount of said low molecular weight liquid fraction from said high molecular weight liquid fraction to form a heavy bottoms stream containing substantially all of said high molecular weight liquid fraction, including substantially all of said mineral matter and substantially all of said unconverted coal constituents, and less than about 50 weight percent of said low molecular weight liquid fraction based on the weight of said high molecular weight liquid fraction;

(d) contacting said heavy bottoms stream with a second stream of hydrogen-donor solvent and a hydrogen-containing gas in a second liquefaction zone at a temperature in the range between about 800° F. and about 1000° F. and at a pressure between about 1000 psig and about 4500 psig;

(e) separating the effluent from said second liquefaction zone into a vaporous fraction and a liquid fraction;

(f) recovering a liquid hydrocarbon stream containing hydrogen-donor solvent constituents from said liquid fraction;

(g) contacting said liquid hydrocarbon stream with hydrogen in a catalytic solvent hydrogenation zone maintained under solvent hydrogenation conditions;

(h) recovering a hydrogenated effluent from said solvent hydrogenation zone;

(i) separating said hydrogenated effluent into a gaseous stream and a liquid stream; and (j) recycling at least a portion of said liquid stream to said first liquefaction zone as said first stream of hydrogen-donor solvent and recycling another portion of said liquid stream to said second liquefaction zone as said second stream of hydrogen-donor solvent.

8. A process as defined in claim 7 wherein said heavy bottoms stream contains less than about 20 weight percent of said low molecular weight liquid fraction based on the weight of said high molecular weight liquid fraction.

9. A process as defined in claim 7 wherein said high molecular weight liquid fraction is composed of substantially all mineral matter and substantially all liquids boiling above a temperature in the range between about 850° F. and about 1100° F. including substantially all high molecular weight unconverted coal constituents.

10. A process as defined in claim 7 wherein said first liquefaction zone is maintained at a temperature in the range between about 800° F. and about 900° F. and at a pressure between about 1000 psig and about 2500 psig and said second liquefaction zone is maintained at a temperature in the range between about 820° F. and about 900° F. and at a pressure between about 1500 psig and about 3000 psig.

11. A multiple-stage hydrogen-donor process for producing liquid hydrocarbons from coal or similar liquefiable carbonaceous solids which comprises:

(a) contacting said carbonaceous solids with a first stream of hydrogen-donor solvent and hydrogen gas in a first liquefaction zone at a temperature in the range between about 800° F. and about 900° F. and at a pressure between about 1000 psig and about 2500 psig to produce a liquefaction effluent;

(b) separating said liquefaction effluent into a vaporous stream and a liquid stream, said liquid stream consisting of a high molecular weight liquid fraction composed of substantially all mineral matter and substantially all liquids boiling above a temperature in the range between about 850° F. and about 1100° F. including substantially all high molecular weight unconverted coal constituents, and a low molecular weight liquid fraction;

(c) separating a sufficient amount of said low molecular weight liquid fraction from said high molecular weight liquid fraction to form a heavy bottoms stream containing substantially all of said high molecular weight liquid fraction, including substantially all of said mineral matter and substantially all of said unconverted coal constituents, and less than about 50 weight percent of said low molecular weight liquid fraction based on the weight of said high molecular weight liquid fraction;

(d) contacting said heavy bottoms stream with a second stream of hydrogen-donor solvent and hydrogen gas in a second liquefaction zone at a temperature in the range between about 820° F. and about 900° F. and at a pressure between about 1000 psig and about 3000 psig;

(e) separating the effluent from said second liquefaction zone into a vaporous fraction and a liquid fraction;

(f) recovering a liquid hydrocarbon stream containing hydrogen-donor solvent constituents from the liquid fraction of step (e) and from the portion of the low molecular weight liquid fraction that was separated from the high molecular weight liquid fraction in step (c);

(g) contacting said liquid hydrocarbon stream with hydrogen in a catalytic solvent hydrogenation zone maintained under solvent hydrogenation conditions;

(h) recovering a hydrogenated effluent from said solvent hydrogenation zone;

(i) separating said hydrogenated effluent into a gaseous stream and a liquid stream; and (j) recycling at least a portion of said liquid stream to said first liquefaction zone as said first stream of hydrogen-donor solvent and recycling another portion of said liquid stream to said second liquefaction zone as said second stream of hydrogen-donor solvent.

12. A process as defined in claim 11 wherein said heavy bottoms stream contains less than about 20 weight percent of said low molecular weight liquid fraction based on the weight of said high molecular weight liquid fraction.

13. A process as defined in claim 11 wherein said high molecular weight liquid fraction is composed of substantially all mineral matter and substantially all liquids boiling above about 1000° F. including substantially all high molecular weight unconverted coal constituents.

* * * * *